United States Patent [19]

Dvorsky et al.

[11] 4,369,041

[45] Jan. 18, 1983

[54] TECHNIQUE FOR DYEING AND PRINTING OF TEXTILES WITH QUATERNARY AMMONIUM COMPOUND

[75] Inventors: Drahomir Dvorsky; Karel Cerovsky, both of Dvur Kralové nad Labem; Jaromir Socha, Pardubice, all of Czechoslovakia

[73] Assignee: Vyzkumny ustav zuslechtovaci, Dvur Kralové nad Labem, Czechoslovakia

[21] Appl. No.: 263,031

[22] Filed: May 12, 1981

[30] Foreign Application Priority Data

| | | | |
|---|---|---|---|
| May 12, 1980 | [CS] | Czechoslovakia | 3285-80 |
| Jul. 1, 1980 | [CS] | Czechoslovakia | 4685-80 |
| Jul. 16, 1980 | [CS] | Czechoslovakia | 5030-80 |

[51] Int. Cl.[3] ..... C09B 67/00

[52] U.S. Cl. ..... 8/532; 8/606; 8/918; 564/281; 564/282; 564/289

[58] Field of Search ..... 8/606, 532; 564/281, 564/282, 289

[56] References Cited

U.S. PATENT DOCUMENTS

| | | | |
|---|---|---|---|
| 3,643,270 | 2/1972 | Kirschnek et al. | 8/606 |
| 3,685,953 | 8/1972 | Cuvelier et al. | 8/542 |
| 3,700,399 | 10/1972 | Shimauchi et al. | 8/606 |
| 3,764,262 | 10/1973 | Hildebrand et al. | 8/606 |

FOREIGN PATENT DOCUMENTS

| | | | |
|---|---|---|---|
| 7203397 | 9/1972 | Netherlands | 8/606 |

*Primary Examiner*—A. Lionel Clingman

[57] ABSTRACT

A technique is described for dyeing and printing textile materials of cellulose fibers and blends thereof with polyester fibers. The technique involves exposing the textile before and/or during the dyeing or printing sequence to the action of quaternary ammonium compound and a compound capable of releasing ammonia at a temperature within the range of 180°-230° C.

13 Claims, No Drawings

TECHNIQUE FOR DYEING AND PRINTING OF TEXTILES WITH QUATERNARY AMMONIUM COMPOUND

This invention relates to novel quaternary ammonium compounds and to a method of use of same for dying cellulose fibers and blends thereof with polyester fibers.

In recent years, a wide variety of quaternary ammonium compounds have been used for dying and printing of cellulose fibers. Typically, these compounds are of the general formulae

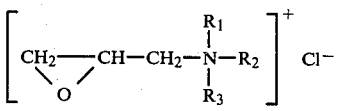

(1)

and

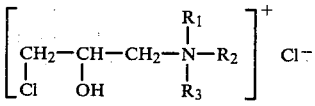

(2)

wherein $R_1$, $R_2$ and $R_3$ represent alkyl groups. Studies have revealed that such compounds result in higher dye yields, enhanced fastness values and lesser need for washing, so increasing the commercial viability of processes using them.

In the operation of such processes, compounds of the type, designated (1) and (2) above, react in alkali media with the hydroxyl groups of cellulose, the former reacting directly and the latter by first converting in the alkali to a compound of formula (1). During the course of the reaction with cellulose, an etherification occurs as the epoxy group of the designated compound reacts with a hydroxyl group of cellulose. The quaternary ammonium group is then capable of binding anionic dyes in the next phase of the process.

The preferred procedure for utilizing such compounds involves cationizing a cellulose containing textile material therewith and in a subsequent step applying the dye thereto. Simultaneous dying and cationizing processes are only advantageous when fabrics are subjected to cold fixation in batch.

Although such processes have achieved some degree of success from a commercial standpoint, workers in the art have continued their efforts toward development of novel processes for dying and printing both cellulose and polyester fibers. Due to the differential dyeability of the components of the blend, utilization of a highly productive single batch single stage is difficult to achieve so that textile fabrics are dyed predominantly in a two bath system or in a single bath two stage system.

The commonly used textile printing processes typically employ pigment dyes which are fixed on the fiber by means of synthetic film-forming bonding agents. Heretofore, the use of dispersion and reactive dyes in these textile printing processes has been complicated by the fact that printing pastes, due to the fixation of a reactive dye, must contain an alkali material which reduces the yield of dispersion dyes. Thus, the white ground of a fabric becomes soiled in a subsequent washing step. Unfortunately, the application of specific dispersion dyes which are capable of being fixed by means of a swelling agent is economically prohibitive and creates ecological problems.

In accordance with the present invention, these prior art limitations are effectively obviated by the use of quaternary ammonium compounds of the formula

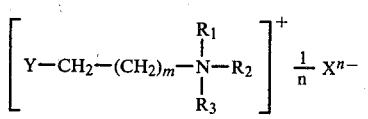

(3)

wherein X represents an anion of a strong acid which may be either organic or inorganic.

Y represents a halogen atom, n is an integer from 1–3, m is an integer from 1–4, $R_1$ and $R_3$ are selected from among a hydrogen atom or an alkyl or hydroxyalkyl group having from 1–5 carbon atoms, and $R_2$ is selected from among an alkyl or hydroxyalkyl group of 1–20 carbon atoms, an alkylaryl group of 7–26 carbon atoms or an aryl group having 6, 10 or 12 carbon atoms.

Studies have revealed that such compounds react with cellulose in the presence of ammonia releasing substances, for example, hexamethylene tetramine and ammonium carbonate, when exposed to temperatures no greater than 180° C., so resulting in the formation of covalent bonds. Thus, these compositions may be used in processes for dying and printing cellulose containing fibrous materials.

It has been determined that the afore-mentioned reaction is neither influenced by the presence of anionic dyes or other textile auxiliary agents such as migration inhibitors and thickeners. Thus, the novel compounds described herein differ markedly from the compositions designated (1) and (2), above.

The mechanism described also is found to occur when dying blends of cellulose and polyester fibers with anionic and dispersion dyes. Simultaneously, due to a thermosol action of a dispersion dye on polyester fiber, a reaction between the inventive composition and cellulose occurs, and at the same time, a quaternary ammonium group binds the anionic dye. Since the dying liquor and the printing paste do not contain alkali, the stability thereof is not impaired and the yield of dispersion dye on the polyester component does not decrease. The cellulosic component may conveniently be covered by the use of reactive acid and metal complex dyestuffs. As a result, the dye liquors and printing pastes contain in addition to dispersion and anionic dyes of formula (1) an ammonic releasing substance and a thickener.

In the practice of the present invention utilizing compounds of formula (3), it is preferred to employ compounds wherein Y is a chlorine or bromine and $R_1$ and $R_2$ represent methyl groups.

Typical anions $X^{n-}$ suitable for use herein may be selected from among chloride, bromide, sulfate, phosphate and anions of organic acids such as those of aromatic and lower aliphatic sulfonic acids such as benzene sulfonate, p-toluene sulfonate, methane sulfonate or ethane sulfonate or anionic residues of acid alkylesters of inorganic acids such as methosulfate or ethosulfate.

Compounds of formula (3) found to be particularly suitable for use in the practice of the present invention are:

N(2-chloroethyl)-N,N,N-trimethylammonium chloride,

N(2-bromomethyl)-N-hydroxyethyl-N,N-dimethylammonium methosulfate,

N(2-chloroethyl)-N,N-dimethul-N-stearylammonium chloride,

N(2-chloroethyl)-N,N-dimethyl-N-benzylammonium chloride,

N(2-chloroethyl)-N,N-dimethyl-N-phenylammonium chloride,

N(2-chloroethyl)-N,N,N-trimethylammonium bromide,

N(2-chloroethyl)-N,N-dimethyl-N-hydroxyethylammonium chloride,

N(5-chloroamyl)-N,N,N-trimethylammonium chloride,

N(3-chloropropyl)-N,N,N-trimethylammonium bromide,

N(4-bromobutyl)-N,N-diethyl-N-benzylammonium chloride,

N(3-bromopropyl)-N,N-dimethyl-N-ethylammonium sulfate,

N(2-chloroethyl)-N,N,N-trimethylammonium methosulfate,

N(2-bromoethyl)-N,N-dimethyl-N-hydroxyethylammonium acetate,

N(2-chloroethyl)-N,N,N-trimethylammonium toluene sulfonate.

These compounds may conveniently be prepared by quaternizing tertiary amines with dihaloalkanes in accordance with the following equation

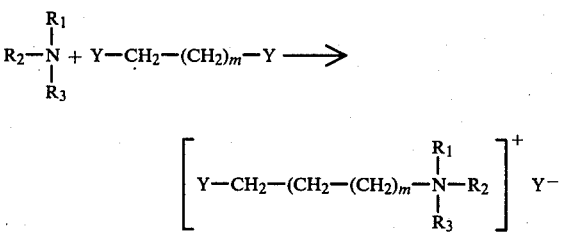

wherein $R_1$, $R_2$, $R_3$, Y and m are as defined in formula (3).

The dyeing process described is suitable for use with yarns, fibrous slivers and textile webs such as woven, knitted or non-woven fabrics, provided that these materials contain hydroxy groups as do the natural or regenerated cellulose fibers.

In the practice of the present invention, a suitable fabric is impregnated with an aqueous liquor containing a quaternary ammonium compound in an amount ranging from 5 to 100 g/kg, a general preference being found for a range of 10–60 g/kg, and a substance capable of releasing ammonia during thermal fixation, such substance being present in an amount ranging from 5 to 100 g/kg.

Ammonia releasing substances suitable for the purpose of the present invention may be selected from among organic compounds such as hexamethylene tetramine and inorganic compounds based upon ammonium salts such as ammonium carbonate.

The printing pastes employed typically contain thickeners such as galactomannates, alginates, carboxymethyl cellulose, hydroxyethyl cellulose, starch or natural gum.

The padding liquor is applied to the textile material at 60–100 percent squeeze. Next, drying at a temperature ranging from 70°–140° C. is effected and then the material is fixed by dry heat or superheated steam, the textile material being treated for a time period ranging from 1–15 minutes at a temperature within the range of 180°–230° C. Following fixation, the material is dyed with a suitable anionic dye using any of the conventional discontinuous, semi-continuous or continuous techniques, dependent upon the particular material employed.

An alternative technique which is preferred in practicing the invention involves the use of a padding liquor or printing paste containing an anionic dye of the direct, reactive or acid type. The prime advantage of this practice resides in the fact that the dye is fixed simultaneously, under the same technological conditions as the padding liquor, so resulting in a high dye yield. In the event optimum conditions are employed, it is possible to achieve the complete exhaustion of the dye, such being advantageous from an economic standpoint. When using substantive dyes, it is possible to obtain a fastness level which corresponds with the more expensive indigosol as well as vat dyes. Still further, improvements in characteristics may be achieved by selection of appropriate substitutes for $R_1$, $R_2$ and $R_3$ in formula (3).

In dyeing blends of cellulose and polyester fibers in a single bath single-stage step, it is necessary to prevent the components from precipitating in the dye liquor or printing paste, so limiting the choice of components of formula (3) compound. Compounds suitable for this purpose are of the following formula

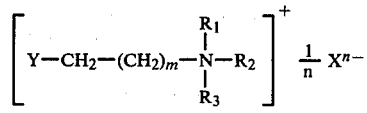

wherein X represents an anion of an inorganic or organic acid, Y represents a halogen atom, m is an integer of 1, n is an integer ranging from 1 to 3, $R_1$ and $R_3$ each represent an alkyl or hydroalkyl group of 1–3 carbon atoms, and $R_2$ represents an alkyl or hydroalkyl group of 1–3 carbon atoms, an alkylaryl group of 7–9 carbon atoms or a phenyl group.

It is also feasible to vary the color deepness in the practice of the invention by the use of printing paste containing such compounds or by the use of anionic dyes in the subsequent dyeing process. The effect of using printing pastes containing varying concentrations of quaternary ammonium compounds of the invention can also be enhanced by the use of selected dyestuffs.

It has been found that the excellent dye fixation achieved in dyeing and printing in accordance with the invention leads to a reduction in dye time and the production of an essentially clear after-dyeing liquor which results in a substantial improvement in the waste water purity.

Several example of the practice of the present invention are set forth below. These examples are merely for purposes of exposition and are not to be considered as limiting.

EXAMPLE 1

A previously boiled and bleached cotton woven fabric was dyed in an open width dyeing machine as follows:

At 30° C., the fabric was impregnated with an aqueous liquor containing 25 grams per liter of N(2-chloroethyl)-N,N,N-trimethylammonium chloride, 20 grams per liter of hexamethylene tetramine and 15 grams per liter of Direct Blue C.I. 67. The fabric was then dried in a hot flue at 100° C. and subjected to dry heat during a 90-second passage through a thermosol hot flue at 200° C. The fabric so treated was then washed with warm and cold water in conventional fashion in an ordinary open width washing machine. The process resulted in a good dye yield such that after dyeing, the wash water was almost clear. The final coloration evidenced very good wet fastness values. Similar results were obtained with the following dyes:

Direct Yellow: C.I. 28
Direct Yellow: C.I. 29
Direct Orange: C.I. 39
Direct Red: C.I. 80
Direct Red: C.I. 76
Direct Violet: C.I. 48
Direct Violet: C.I. 46
Direct Blue: C.I. 106
Direct Blue: C.I. 71
Direct Blue: C.I. 78
Direct Blue: C.I. 86
Direct Green: C.I. 28
Direct Brown: C.I. 103
Direct Brown: C.I. 218
Direct Black: C.I. 56

Similar results were obtained by substituting the following quaternary ammonium compounds in the aqueous liquor.

N(2-bromomethyl)-N-hydroxyethyl-N,N-dimethylammonium methosulfate
N(2-chloroethyl)-N,N-dimethyl-N-phenylammonium chloride
N(2-chloroethyl)-N,N,N-trimethylammonium bromide
N(2-chloropropyl)-N,N,N-trimethylammonium bromide
N(3-bromopropyl)-N,N-dimethyl-N-ethylammonium sulphate
N(2-chloroethyl)-N,N,N-trimethylammonium methosulphate
N(2-bromoethyl)-N,N-dimethyl-N-hydroxyethylammonium acetate
N(2-chloroethyl)-N,N,N-trimethylammonium toluene sulfonate.

And finally, similar results may be obtained by substituting ammonium carbonate for hexamethylene tetramine.

EXAMPLE 2

A prewashed and bleached knitted fabric of cotton and rayon (67/33) was printed with a printing paste containing 540 grams of sodium aglinate (4 percent aqueous solution), 30 grams of N(2-bromomethyl)-N-hydroxyethyl-N,N-dimethylammonium methosulphate, 30 grams of ammonium carbonate and 400 grams of water.

The fabric was printed by conventional stencil printing techniques. Following drying in a loft dryer at 90° C., the print was subjected to fixation by superheated steam at 190° C. for 4 minutes. Then, the printed fabric was dyed alkali-free on a winch by Reactive Blue (C.I. 4) (2 percent saturation related to the fabric weight). Dyeing was initiated at 40° C. while adding dye to the bath. Then, the temperature was increased to 80° C. and maintained for 40 minutes. Next, the fabric was washed and soaped under a boil, so resulting in a blue shade evidencing very good fastness values with deeply dyed printed areas.

Similar results were obtained with the following dyes:

Reactive Yellow: C.I. 3
Reactive Yellow: C.I. 2
Reactive Orange: C.I. 12
Reactive Orange: C.I. 5
Reactive Orange: C.I. 13
Reactive Red: C.I. 24
Reactive Red: C.I. 45
Reactive Red: C.I. 31
Reactive Violet: C.I. 1
Reactive Blue: C.I. 5
Reactive Blue: C.I. 13
Reactive Green: C.I. 8
Reactive Brown: C.I. 2
Reactive Black: C.I. 8

Similar results were also obtained by substitution of hexamethylene tetramine for ammonium carbonate or by use of any of the following quaternary ammonium compounds:

N(2-chloroethyl)-N,N,N-trimethylammonium chloride
N(2-chloroethyl)-N,N-dimethyl-N-benzylammonium chloride
N(2-chloroethyl)-N,N-dimethyl-N-phenylammonium chloride
N(2-chloroethyl)-N,N,N-trimethylammonium bromide
N(4-bromobutyl)-N,N-diethyl-N-benzylammonium chloride
N(3-bromopropyl)-N,N-dimethyl-N-ethylammonium sulphate
N(2-chloroethyl)-N,N,N-trimethylammonium toluene sulfonate.

EXAMPLE 3

A pretreated linen woven fabric was impregnated at 20° C. in a padder with an aqueous liquor containing 30 grams per liter of N(2-chloroethyl)-N,N-stearylammonium chloride, 20 grams per liter of hexamethylene tetramine and 10 grams per liter of Reactive Red, C.I. 24.

Following drying at 100° C., the fabric was subjected to a 60-second hot air fixation in a thermosol plant at a temperature of 210° C. and then washed and soaped. The final coloration evidenced good fastness values and the fabric was characterized by a durable soft hand.

Similar results were obtained with the reactive dyes of Example 2 and by substitution of ammonium carbonate for hexamethylene tetramine.

EXAMPLE 4

A pretreated polyester/cotton (67-33) blend woven fabric was impregnated at 30° C. in a padder with an aqueous liquor containing 25 g/liter N(2-chloroethyl)-N,N,N-trimethylammonium chloride
20 g/liter hexamethylene tetramine
15 g/liter Dispersion Blue C.I. 73
7 g/liter Direct Blue C.I. 67
5 g/liter sodium alginate (4 percent aqueous solution).

Next, the impregnated fabric was dried with hot air at 90° C. and then subjected to a 50-second hot air fixation in a thermosol plant at a temperature of 210° C. Following, the fabric was washed with hot water at 80° C. in an open width washing machine. The resultant color shade evidenced good fastness values, the shades of the two blended components being uniform.

A similar effect was obtained with the following dispersion dyes:

Dispersion Yellow: C.I. 42
Dispersion Orange: C.I. 31
Dispersion Red: C.I. 54

Dispersion Red: C.I. 72
Dispersion Blue: C.I. 79
Dispersion Blue: C.I. 73

Direct dyes of the type employed in Example 1 yielded similar results as did substitution of the following quaternary ammonium compounds for that employed herein:

N(2-bromomethyl)-N-hydroxyethyl-N,N-dimethylammonium methosulphate
N(2-chloroethyl)-N,N,N-trimethylammonium bromide
N(3-chloropropyl)-N,N,N-trimethylammonium bromide
N(3-bromopropyl)-N,N-dimethyl-N-ethylammonium sulphate
N(2-chloroethyl)-N,N,N-trimethylammonium methosulphate
N(2-bromoethyl)-N,N-dimethyl-N-hydroxyethylammonium acetate.

Similar results were also obtained by using ammonium carbonate rather than hexamethylene tetramine.

EXAMPLE 5

A pretreated polyester/flax (70/30) blend woven fabric was printed in a flat printing machine with a printing paste containing:

30 g N(2-chloroethyl)-N,N-dimethyl-N-hydroxyethylammonium bromide
20 g hexamethylene tetramine
30 g Dispersion Red C.I. 121 15 g Reactive Red C.I. 24
500 g sodium alginate (4 percent aqueous solution)
405 g water After drying at a temperature ranging from 100°–110° C., the fabric was given a 60-second hot air fixation at 200° C. Next, it was passed through an open width washing machine and washed with water at 50° C. The final print evidenced good fastness values, particularly wet fastness, uniform coverage of the two blend components and a high purity of white ground.

A similar effect was obtained using a dispersion dye of the type employed in Example 4 or a reactive dye of the type employed in Example 2.

Additionally, the following quaternary ammonium yielded similar results when substituted for the above-noted compound:

N(2-chloroethyl)-N,N,N-trimethylammonium chloride
N(2-bromomethyl)-N-hydroxyethyl-N,N-dimethylammonium methosulphate
N(2-chloroethyl)-N,N,N-trimethylammonium bromide
N(3-chloropropyl)-N,N,N-trimethylammonium bromide
N(2-bromopropyl)-NKN-dimethyl-N-ethylammonium sulphate
N(2-chloroethyl)-N,N,N-trimethylammonium methosulphate
N(2-bromoethyl)-N,N-dimethyl-N-hydroxyethylammonium acetate.

Hexamethylene tetramine was replaced by ammonium carbonate in the printing paste with similar results.

EXAMPLE 6

A pretreated polyester/rayon (70/30) blend woven fabric was impregnated at 15° C. in a padder with an aqueous liquor containing 30 g/liter N(2-chloroethyl)-N,N-dimethyl-N-benzylammonium chloride
15 g/liter ammonium carbonate
20 g/liter Dispersion Yellow C.I. 42
10 g/liter Dispersion Blue C.I. 73
10 g/liter Acid Green C.I. 12.

The impregnated fabric was then treated in accordance with the procedure of Example 4. The final coloration evidenced very good fastness values, especially wet fastness, as well as uniform coverage of the two components of the blend. Similar results were achieved using dispersion dyes of the type described in Example 4 or any of the following acid dyes:

Acid Black: C.I. 26
Acid Blue: C.I. 113
Acid Black: C.I. 52
Acid Yellow: C.I. 42

Replacement of the quaternary ammonium compound with any of the following compounds also yielded similar results:

N(2-chloroethyl)-N,N,N-trimethylammonium chloride
N(2-bromomethyl)-N-hydroxyethyl-N,N-dimethylammonium methosulphate
N(2-chloroethyl)-N,N,N-trimethylammonium bromide.

EXAMPLE 7

A preferred cotton woven fabric was impregnated at a temperature ranging from 20°–25° C. and 80 percent squeeze, by an aqueous liquor containing 30 g/liter N(5-chloroamyl)-N,N,N-trimethylammonium chloride
20 g/liter hexamethylene tetramine.

The impregnated fabric was dried with hot air in a hot flue drier at a temperature ranging from 100°–110° C. and then subjected to a 60-second hot air fixation at 200° C. The fabric was then dyed in a jigger using Direct Blue C.I. 107 (2 percent saturation, relative to fabric weight) without other additives.

The dye was dosed into the jigger at 30° C. and the fabric dyed in eight passages (two passaged at 30° C., two passages at 60° C. and four passages at 90° C.) and then washed in the jigger with warm and cold water.

A deep blue shade resulted with very good fastness values, particularly wet and light fastness. The yield of the dye in the jigger was very high so the dye was almost fully exhausted from the bath.

A similar effect was achieved using a direct dye of the type described in Example 1 or by replacing the quaternary ammonium compound with one of those described in Example 2.

Similar results were obtained by substitution of ammonium carbonate for hexamethylene tetramine.

A pretreated cotton/rayon (67/33) blend woven fabric was printed with a printing paste containing 25 g N(3-chloropropyl)-N,N,N-trimethylammonium bromide
20 g Reactive Red C.I. 2
20 g hexamethylene tetramine
60 g sodium alginate (4 percent aqueous solution)
875 g water The fabric was printed and dried in accordance with the procedure of Example 2. The dry fabric was then subjected to a 60-second hot air fixation at 205° C. Following this, the fabric was washed and soaped. The final print evidenced very good fastness, especially wet fastness, and a high dye yield. Similar effects were obtained using one of the reactive dyes described in Example 2 or by replacing the quaternary ammonium compound with any of the compounds of Example 5.

Ammonium carbonate was substituted for hexamethylene tetramine with similar results.

EXAMPLE 9

A rayon woven fabric dyed by Direct Orange C.I. 39 was impregnated at ambient temperature by an aqueous liquor containing 20 g/liter N(2-bromobutyl)-N,N-diethyl-N-benzylammonium chloride 15 g/liter ammonium carbonate.

The impregnated fabric was dried and subjected to a 90-second hot air fixation at 190° C. After fixation, the fabric was washed in an open width washing machine with warm and cold water and dried again. The resultant color shade evidenced very high fastness values, especially wet fastness. The process was found suitable for enhancing color fastness of fabrics dyed by direct dyes using conventional techniques. Similar results were obtained using the quaternary ammonium compounds set forth in Example 4 and by replacing ammonium carbonate with hexamethylene tetramine.

We claim:

1. Method for dyeing textile materials comprising cellulose fibers and blends thereof with polyester fibers which comprises the steps for dyeing said fibers and subjecting the dyed fibers to a high temperature fixation characterized in that the textile material is exposed to the action of a quaternary ammonium compound and an ammonia releasing substance selected from the group consisting of hexamethylene tetramine and ammonium carbonate at a temperature within the range of 180°-230° C., said quaternary ammonium compound being of the formula

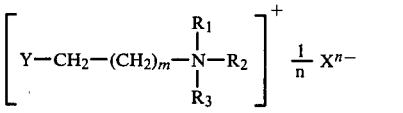

wherein

X is an anion of a strong acid,

Y represents a halogen atom, n is an integer from 1-3, m is an integer from 1-4, $R_1$ and $R_3$ are selected from the group consisting of an alkyl group, a hydroxyalkyl group and a hydrogen atom, said alkyl and hydroxyalkyl having from 1-5 carbon atoms, and $R_2$ is selected from the group consisting of an alkyl group, a hydroxyalkyl group, each of which has from 1-20 carbon atoms, an alkylaryl group having from 7-26 carbon atoms, and an aryl group of 6, 10 or 12 carbon atoms.

2. Method in accordance with claim 1 wherein the textile material is exposed to the quaternary ammonium compound and the ammonia releasing substance prior to dyeing.

3. Method in accordance with claim 1 wherein the textile material is exposed to the quaternary ammonium compound and the ammonia releasing substance during the dyeing.

4. Method in accordance with claim 1 wherein said quaternary ammonium compound is N(2-chloroethyl)-N,N,N-trimethylammonium bromide.

5. Method in accordance with claim 1 wherein said quaternary ammonium compound is N(2-bromoethyl)-N-hydroxyethyl-N,N-dimethylammonium methosulfate.

6. Method in accordance with claim 1 wherein said quaternary ammonium compound is N(2-chloroethyl)-N,N-dimethyl-N-phenylammonium chloride.

7. Method in accordance with claim 1 wherein said quaternary ammonium compound is N(3-chloropropyl)-N,N,N-trimethylammonium bromide.

8. Method in accordance with claim 1 wherein said quaternary ammonium compound is N(3-bromopropyl)-N,N-dimethyl-N-ethylammonium sulfate.

9. Method for treating textile materials in a single-bath single stage process with a dye characterized in that the materials are exposed to the action of a quaternary ammonium compound and an ammonia releasing substance selected from the group consisting of hexamethylene tetramine and ammonium carbonate at a temperature within the range of 180°-230° C., said quaternary ammonium compound being of the formula

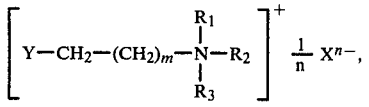

wherein

X represents an acid anion,

Y represents a halogen atom, m is equal to 1, n is an integer from 1-3, $R_1$ and $R_3$ each represent an alkyl or hydroxyalkyl group of 1-3 carbon atoms, and $R_2$ represents an alkyl or hydroxyalkyl group of 1-3 carbon atoms, on alkylaryl group of 7-9 carbon atoms or a phenyl group.

10. Method in accordance with claim 9, wherein said treatment is a printing treatment utilizing an aqueous paste as a vehicle for said quaternary ammonium compound.

11. Method in accordance with claim 9, wherein said treatment is a dyeing treatment utilizing an aqueous bath of said quaternary ammonium compound.

12. Method in accordance with claim 9, wherein said dye is an anionic dye.

13. Method in accordance with claim 9, wherein said dye is a dispersion dye.

* * * * *